US011059289B1

(12) United States Patent
Praharaj et al.

(10) Patent No.: US 11,059,289 B1
(45) Date of Patent: Jul. 13, 2021

(54) SYSTEM AND METHOD TO DETECT INK DROP DIRECTIONALITY DEGRADATION AND PERFORM REMEDIAL MEASURES TO PREVENT FAILING INKJETS IN PRINTHEADS

(71) Applicant: Xerox Corporation, Norwalk, CT (US)

(72) Inventors: Seemit Praharaj, Webster, NY (US); Douglas K. Herrmann, Webster, NY (US); Paul J. McConville, Webster, NY (US); Jason M. LeFevre, Penfield, NY (US); Chu-heng Liu, Penfield, NY (US); David A. VanKouwenberg, Avon, NY (US); Michael J. Levy, Webster, NY (US); Linn C. Hoover, Webster, NY (US); Thomas J. Wyble, Williamson, NY (US); John P. Meyers, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 41 days.

(21) Appl. No.: 16/724,459

(22) Filed: Dec. 23, 2019

(51) Int. Cl.
*B41J 2/125* (2006.01)
*B41J 29/393* (2006.01)
*B41J 2/165* (2006.01)

(52) U.S. Cl.
CPC ..... *B41J 2/125* (2013.01); *B41J 2/16579* (2013.01); *B41J 2/16585* (2013.01); *B41J 29/393* (2013.01)

(58) Field of Classification Search
CPC ..... B41J 2/125; B41J 2/16585; B41J 29/393; B41J 2/16579
See application file for complete search history.

(56) References Cited

U.S. PATENT DOCUMENTS

2005/0168517 A1 8/2005 Usuda
2009/0109257 A1 4/2009 Shimazaki
2012/0194604 A1 8/2012 Tamaki et al.
2013/0241992 A1 9/2013 Shimizu et al.

FOREIGN PATENT DOCUMENTS

JP 2009035379 A * 2/2009

OTHER PUBLICATIONS

Murakami, Satoru, "Paper Sheeting Conveying Device and Image Device", Feb. 12, 2009, p. 8, Paragraphs 4-5, p. 10, Paragraphs 2-6 (Year: 2009).*
IP.com search (Year: 2021).*

* cited by examiner

*Primary Examiner* — Lisa Solomon
(74) *Attorney, Agent, or Firm* — Maginot Moore & Beck LLP

(57) ABSTRACT

A directionality detector is configured for use in an inkjet printer to attenuate the effects of ink drying in the nozzles of a printhead during printing operations. The directionality detector includes an optical sensor that generates image data of a test pattern formed on media by the printer, a diffuser that emits humidified air toward the media before the media is printed, and a controller operatively connected to the optical sensor and diffuser. The controller is configured compare the image data of the test pattern to stored image data of the test pattern printed at a previous time and determine whether any difference between the two images is greater than a predetermined threshold. The controller then operates the diffuser to direct humidified air toward the media passing the diffuser using the differences between the stored image data of the test pattern and the image data of the test pattern.

21 Claims, 7 Drawing Sheets

SYSTEM AND METHOD TO DETECT INK DROP DIRECTIONALITY DEGRADATION AND PERFORM REMEDIAL MEASURES TO PREVENT FAILING INKJETS IN PRINTHEADS

TECHNICAL FIELD

This disclosure relates generally to devices that produce ink images on media, and more particularly, to devices that eject ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. The actuators in the inkjets of the printheads respond to the firing signals by expanding into an ink chamber to eject ink drops through the inkjet nozzles onto an image receiving member and form an ink image that corresponds to the digital image used to generate the firing signals.

Some inkjet imaging devices use inks that change from a low viscosity state to a high viscosity state relatively quickly. Aqueous inks are such inks and they can dry out quickly in inkjets that are not operated relative frequently even during printing operations. Additionally, some aqueous ink colors are more susceptible to drying than other ink colors. Also, miniscule ink satellites produced with the drops during the printing process may land near the inkjet nozzles and over time dry causing those nozzles to fail. One way of addressing this problem is to fire inkjets that are not being used to form a portion of the ink image so ink continues to move through the inkjets and does not dry. Firing unused inkjets, however, without adversely impacting the quality of the ink image is difficult as intricate schemes are necessary to distribute the extraneous ink over the ink image to camouflage the extraneous ink from the eye of a human observer. In addition, the failure of only a limited number of failing inkjets can be compensated before the failures become catastrophic because adjacent inkjets also fail. Being able to maintain the viscosity level of aqueous inks in inkjets so they do not dry out during print operations as well as preventing ink satellites from drying out completely in the vicinity of the adjacent inkjet nozzles would be beneficial.

SUMMARY

A method of inkjet printer operation detects failing inkjets before they become inoperative and improves conditions in the print zone of the printer so the inkjets are restored to operational status without purging or other printhead maintenance procedures. The method includes operating with a controller a media transport to move media past a plurality of printheads in a process direction, operating with the controller the plurality of printheads to form a test pattern on the media with one or more inkjets in the printheads, generating with an optical sensor image data of the test pattern formed on the media after the media has passed the plurality of printheads, comparing with the controller the image data of the media received from the optical sensor to stored image data of the test pattern printed at a previous time, identifying with the controller a difference between the image data of the media and the stored image data of the test pattern, determining whether the identified difference is greater than a predetermined threshold, and operating with the controller a diffuser to direct humidified air toward the media passing the diffuser before the media passes the plurality of printheads when the difference between the image data of the media and the stored image data of the test pattern is greater than the predetermined threshold.

An inkjet printer is configured with a device that detects failing inkjets before they become inoperative and improves conditions in the print zone of the printer so the inkjets are restored to operational status without purging or other printhead maintenance procedures. The printer includes a plurality of printheads, each printhead having a plurality of inkjets operatively connected to a supply of ink, a media transport for moving media past the printheads in a process direction, an optical sensor positioned so the media passes the optical sensor after the media passes the plurality of printheads, the optical sensor being configured to generate image data of the media after the media has passed the plurality of printheads, a diffuser positioned so the media passes the diffuser before the media passes the plurality of printheads, the diffuser being configured to emit humidified air toward the media passing the diffuser, and a controller operatively connected to the plurality of printheads, the media transport, the optical sensor, and the diffuser. The controller is configured to operate the media transport to move media past the diffuser, the plurality of printheads, and the optical sensor in the process direction, operate the inkjets in the printheads to eject ink drops toward the media as the media passes the printheads to form a test pattern on the media, receive from the optical sensor image data of the media after the test pattern has been formed on the media, compare the image data of the media to stored image data of the test pattern printed at a previous time, identify a difference between the image data of the media and the stored image data of the test pattern, and determine whether the identified difference is greater than a predetermined threshold, and operate the diffuser to direct humidified air toward the media passing the diffuser when the difference between the image data of the media and the stored image data of the test pattern is greater than the predetermined threshold.

A directionality degradation detector detects failing inkjets before they become inoperative and improves conditions in the print zone of the printer so the inkjets are restored to operational status without purging or other printhead maintenance procedures. The directionality degradation detector includes an optical sensor positioned so media passes the optical sensor after a test pattern has been formed on the media by at least a portion of the inkjets in a plurality of printheads, the optical sensor being configured to generate image data of the test pattern on the media, a diffuser configured to emit humidified air toward the media before the test pattern is formed on the media, and a controller operatively connected to the optical sensor and the diffuser. The controller is configured to receive from the optical sensor image data of the media after the test pattern has been formed on the media, compare the image data of the media to stored image data of the test pattern printed at a previous time, identify a difference between the image data of the media and the stored image data of the test pattern, and determine whether the identified difference is greater than a predetermined threshold, and operate the diffuser to direct humidified air toward the media passing the diffuser when the difference between the image data of the media and the stored image data of the test pattern is greater than the predetermined threshold.

BRIEF DESCRIPTION OF THE DRAWINGS

The foregoing aspects and other features of a system and method that detects failing inkjets before they become inoperative and improves conditions in the print zone of a printer so the inkjets are restored to operational status without purging or other printhead maintenance procedures are explained in the following description, taken in connection with the accompanying drawings.

DETAILED DESCRIPTION

Figure 1:
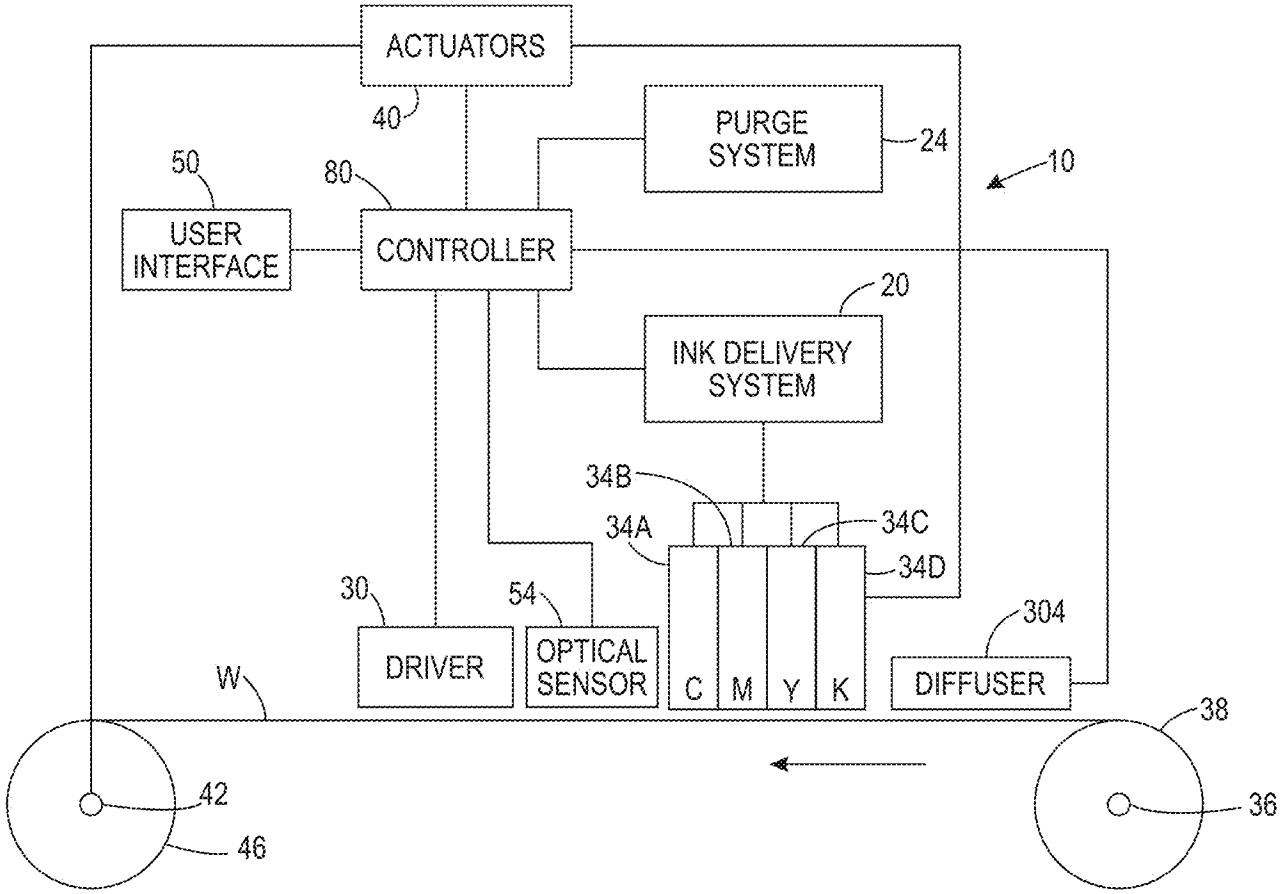
FIG. 1 is a schematic drawing of an aqueous inkjet printer that detects failing inkjets before they become inoperative and improves conditions in the print zone of a printer so the inkjets are restored to operational status without purging or other printhead maintenance procedures.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction in the plane of the image receiving surface.

FIG. 1 illustrates a high-speed aqueous ink image producing machine or printer 10 in which a controller 80 has been configured to operate a moisture diffuser 304 so the ink at the nozzles of the printheads 34A, 34B, 34C, and 34D to help maintain the operational status of the inkjets in the printheads during printing jobs. As used in this document, the term "diffuser" means a device that increases the moisture content of ambient air at the device. As illustrated, the printer 10 is a printer that directly forms an ink image on a surface of a web W of media pulled through the printer 10 by the controller 80 operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction.

The ink delivery subsystem 20 has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of a purge system 24 are also operatively connected between the ink reservoirs and the printheads within the printhead modules to perform manifold and inkjet purges. Additionally, although not shown in FIG. 1, each printhead in a printhead module is connected to a corresponding waste ink tank with a valve to collect ink produced by manifold and inkjet purge operations. The printhead modules 34A-34D can include associated electronics for operation of the one or more printheads by the controller 80 although those connections are not shown to simplify the figure. Although the printer 10 includes four printhead modules 34A-34D, each of which has two arrays of printheads, alternative configurations include a different number of printhead modules or arrays within a module. The controller 80 also operates the moisture diffuser 304 to restore the low viscosity of the ink in the nozzles of the printheads in the printhead modules as described more fully below. An optical sensor 54 generates image data of the media after it is printed by the printheads and this image data is analyzed by the controller 80 to detect failing inkjets in the printheads.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80 operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80. The ESS or controller 80 is operably connected to the components of the ink delivery system 20, the purge system 24, the printhead modules 34A-34D (and thus the printheads), the actuators 40, the heater 30, and the print zone environmental conditioner 60. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either a scanning system or an online or work station connection for processing and generation of the printhead control signals output to the printhead modules 34A-34D. Additionally, the controller 80 determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2B:
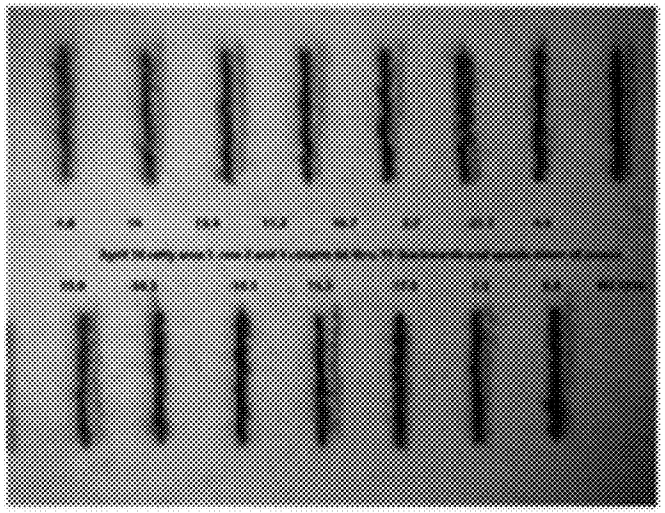
FIG. 2A shows an inkjet test pattern in which the inkjets are ejecting ink drops without directionality degradation demonstrative of a failing inkjet and FIG. 2B shows an inkjet test pattern in which the inkjets are ejecting ink drops with a directionality degradation indicative of a failing inkjet.
Figure 2A:
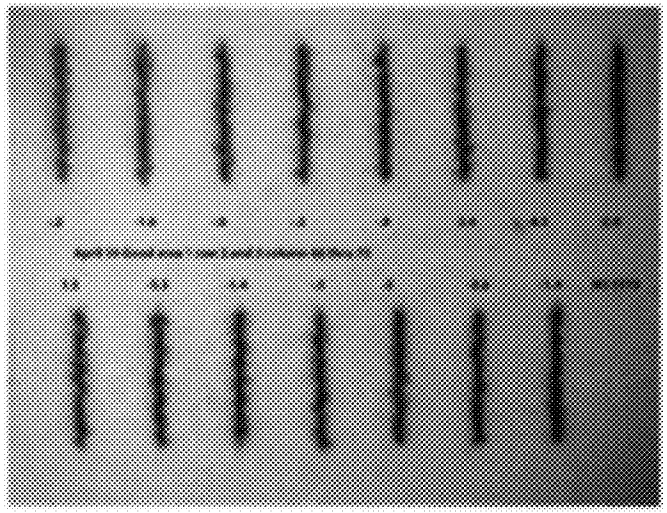

The inventors of the present system and method have observed that as an inkjet begins to fail it demonstrates a detectable deviation from its nominal ink drop directionality. As used in this document, the term "directionality" means a generally straight line between a nozzle ejecting an ink drop and the position where the ink drop lands during a printing operation. This effect is shown in FIG. 2A and FIG. 2B. In FIG. 2A, fifteen individual inkjets have each ejected a single line in the process direction P. In FIG. 2B, the same fifteen individual inkjets have each ejected a single line in the process direction P after some predetermined number of pages has been printed. The lines in FIG. 2B are wider and exhibit degraded ink drop directionality in the cross-process direction than the lines in FIG. 2A. By periodically printing a test pattern of individual lines from all of the inkjets in the printheads of a printer, generating image data of the lines with the optical sensor 54, and the controller 80 comparing this image data to image data of the lines printed by the same inkjets when the inkjets were calibrated at the factory, the controller can identify the directionality of the ink drops printed by the inkjets and identify the inkjets that are beginning to fail before they become inoperative. The image data of the lines printed at the factory is stored in a memory operatively connected to the controller for the comparison analysis.

Figure 3A:
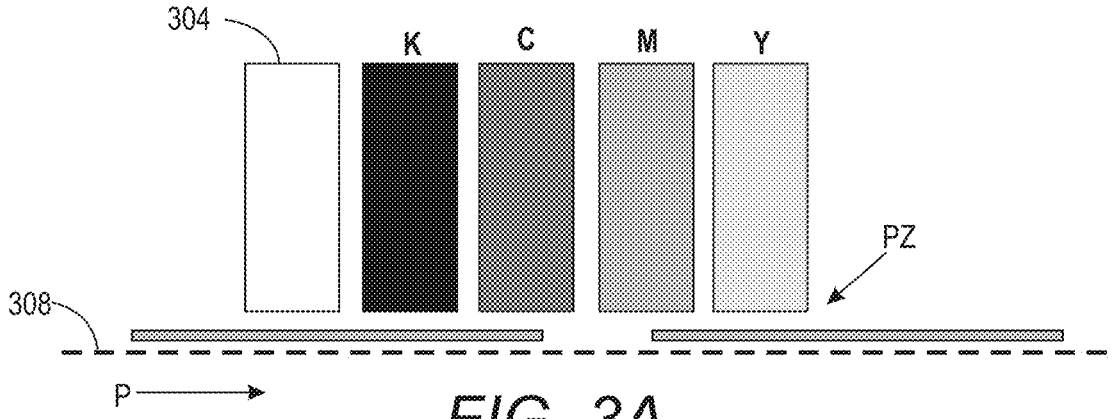
FIG. 3A is a side view of a print zone in a printer having a moisture diffuser configured to aid in the recovery of failing inkjets and FIG. 3B is a perspective view of the configuration shown in FIG. 3A.
Figure 3B:
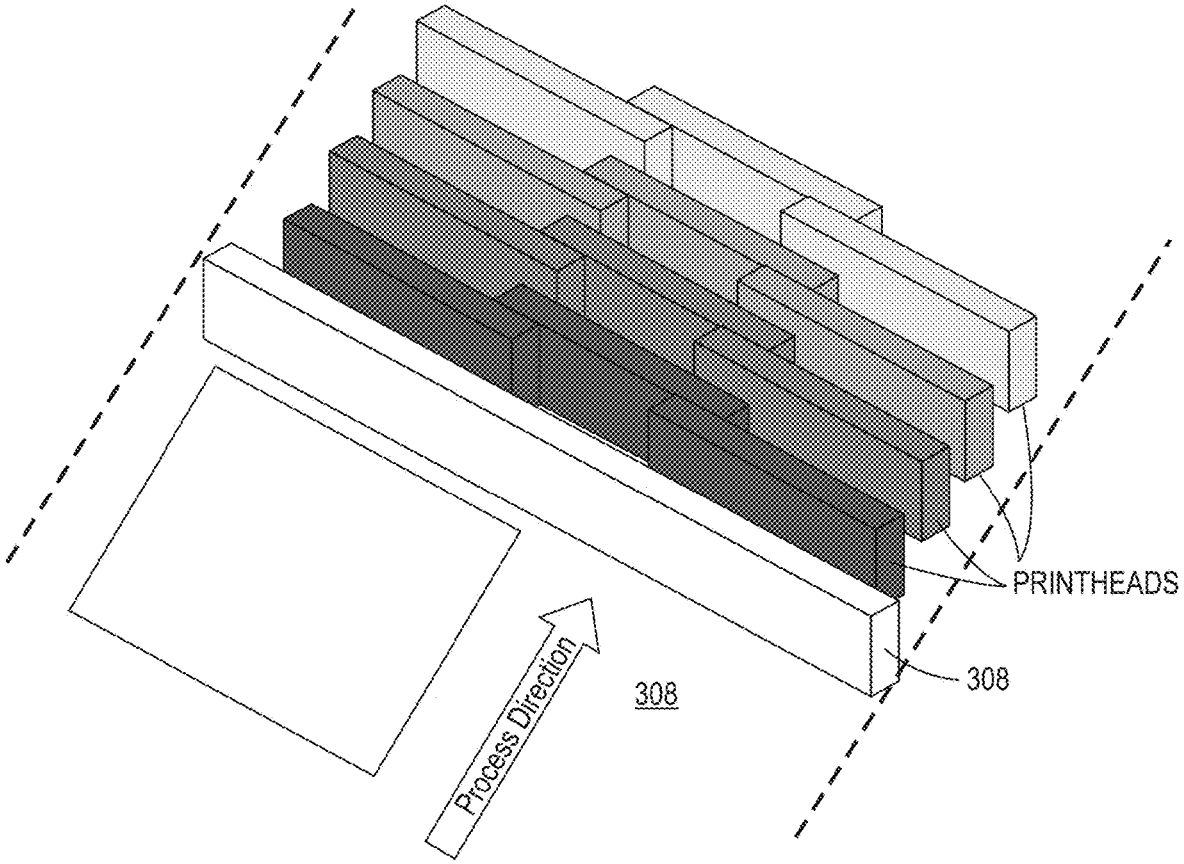

To remediate inkjets that are identified as beginning to fail, a moisture diffuser array can be configured and positioned in the process direction before media passes through the print zone opposite the printheads. A side view of such a configuration is shown in FIG. 3A. The moisture diffuser 304 is positioned in the process direction before the first printhead or printhead array, which is a black printhead array in the figure, in the print zone PZ so the humidified air produced by the diffuser is carried by the media or the media carrying transport into the print zone. As used in this document, the term "print zone" means the space between the printheads and the media transport opposite the printheads in a printer. In FIG. 3A, the humidified air is produced in the area between the diffuser 304 and the media transport 308 or the web W (FIG. 1) so the transport or the web moves the humidified air into the print zone. In one embodiment, the diffuser 304 is operated at a baseline level to direct uniformly humidified air toward the passing media to provide a nominal level of moisture in the print zone that helps keep the ink in the nozzles of the inkjets sufficiently wet so the ink does not dry in the nozzles. The configuration of the diffuser 304 and printheads is also shown in FIG. 3B in a perspective view that shows the diffuser 304 extends across the entire width of the cross-process direction of the media transport 308 or web.

Figure 4A:
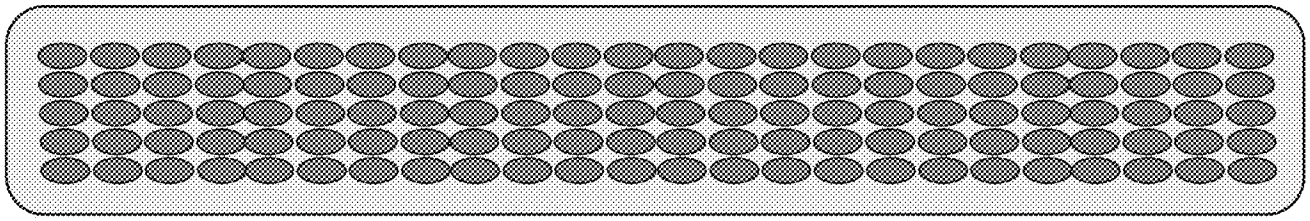
FIG. 4A is a view of the face of the moisture diffuser shown in FIG. 3A and FIG. 3B
Figure 4B:
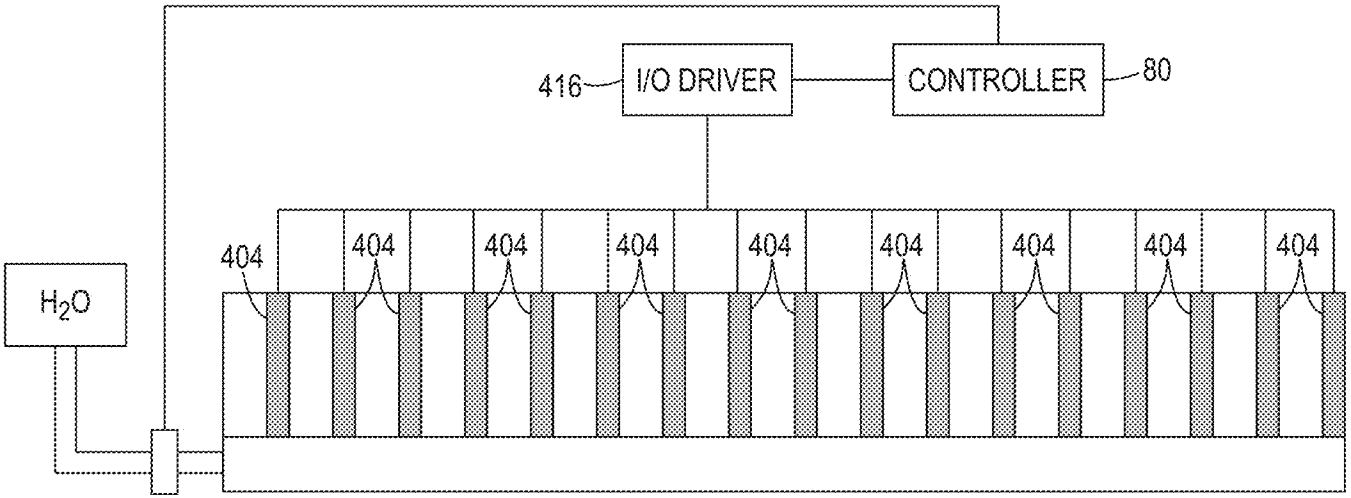
FIG. 4B is a side view of the diffuser.

A view of the face of the diffuser 304 that is opposite the media transport 308 or web W is shown in FIG. 4A. The diffuser 304 is comprised of a plurality of diffusers 404 configured in a rectangular array, although other array shapes can be used. Each diffuser 404 is an ultrasonic transducer 408 and a reservoir of water 412 is positioned across the face of the diffuser 304 as shown in FIG. 4B. An example of such an ultrasonic transducer is the SPAZEL mini-diffuser available through amazon.com. The controller 80 can operate the I/O driver 416 to generate and deliver energizing signals to the transducers independently so all or less than all of the transducers are operated to vibrate the water in the water reservoir 412 and produce humidified air in all or only some areas of the media opposite the diffuser. In some embodiments, the I/O driver 416 can be operated to provide the transducers with signals having an amplitude that can be varied across a range of amplitudes. Smaller amplitude signals produce lesser vibrations and less humidified air while larger amplitudes produce more intense vibrations and higher humidified air. Thus, the controller can operate the transducers in the diffuser so some portions of the diffuser produce more humidified air than other portions of the diffuser. This operation of the diffuser enables the controller to produce more humidified air in the cross-process direction for a portion of a printhead array that is beginning to exhibit directionality degradation while continuing to operate the transducers in the remainder of the diffuser at a different level of moisture production. This flexibility enables the controller to perform a closed loop operation of the diffuser. Thus, the optical sensor 54, the diffuser 304, and the controller 80 form a directionality degradation detector and remedial system.

Figure 5:
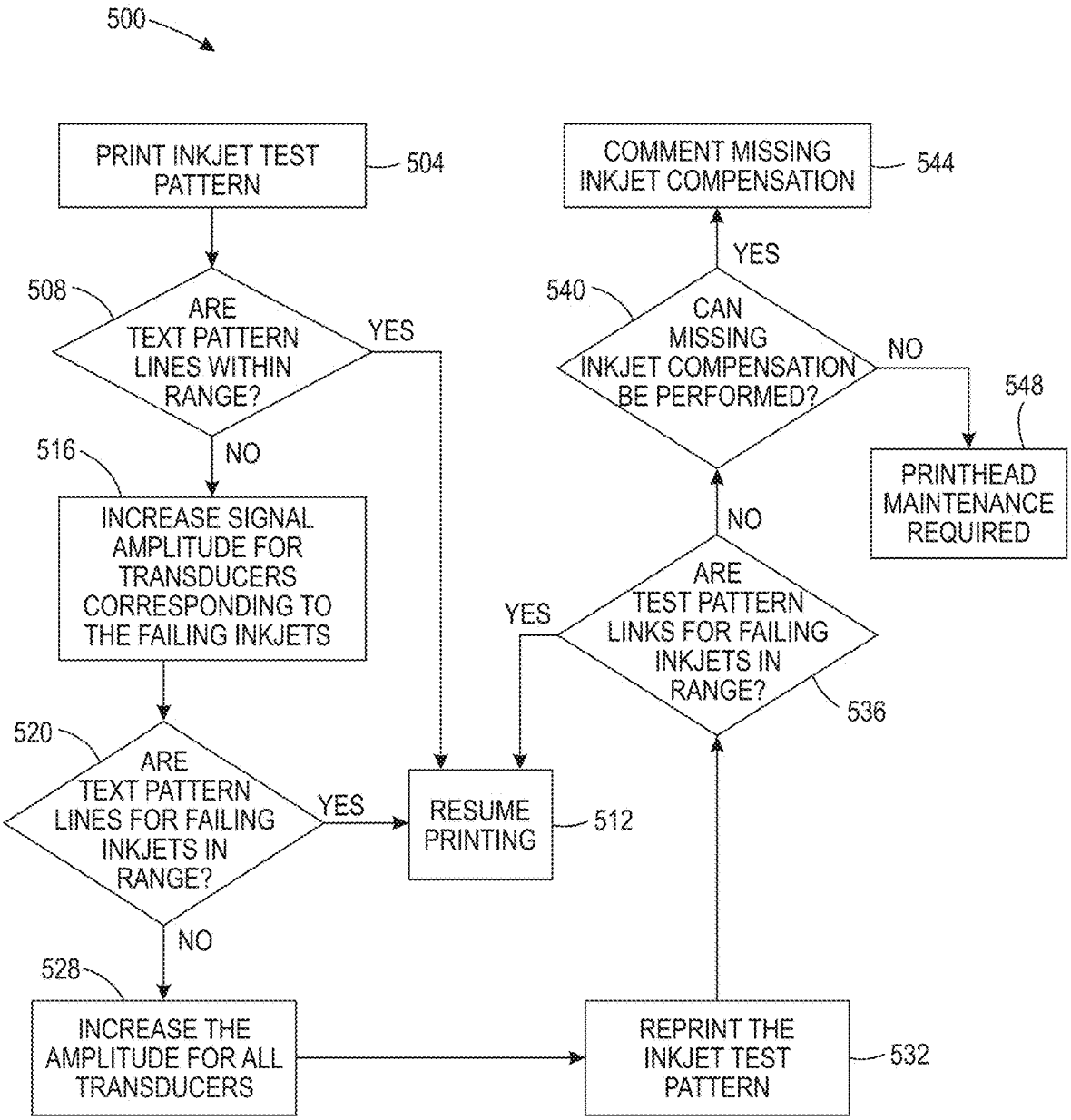
FIG. 5 is a flow diagram of a process used to operate the printer of FIG. 1 that detects failing inkjets before they become inoperative and improves conditions in the print zone so the inkjets are restored to operational status without purging or other printhead maintenance procedures.

A process for operating the printer 10 having a diffuser 304 and a controller configured to detect directional abnormalities in the ink drops from an inkjet is shown in FIG. 5. In the discussion below, a reference to the process 500 performing a function or action refers to the operation of a controller, such as controller 80, to execute stored program instructions to perform the function or action in association with other components in the printer. The process 500 is described as being performed for a diffuser 304 installed in the printer 10 of FIG. 1 for illustrative purposes.

Process 500 begins with the controller 80 occasionally operating the inkjets in the printer to print a test pattern of lines for each inkjet in the printer (block 504). The controller 80 receives image data of the test pattern from the optical sensor and compares this data to the image data of the test pattern printed when the printheads were calibrated at a factory (block 508). If the directionality of the ink drops from all of the inkjets is below a predetermined threshold, then printing is resumed (block 512). If the deviation of the ink drops from any one of the inkjets is greater than a predetermined range about the test pattern portion corresponding to an inkjet in the image data of the calibrated test pattern, then the controller increases the amplitude in the signals used to operate the transducers in the diffuser in the cross-process direction vicinity of the inkjet or inkjets exhibiting the greater ink drop deviation (block 516). At the next printing of the test pattern, the pattern printed by the inkjets corresponding to the previously detected directionality degradation is checked to determine whether the ink drop directionality degradation has been reduced by the increased humidity (block 520). If it has, then the amplitude of the signals operating the transducers corresponding to the failing inkjets is reduced and printing resumes (block 512). If the directionality degradation of the ink drops for the inkjets remains the same or has increased, then a maximum amplitude signal is supplied to all of the transducers in the diffuser so the amount of humidified air in the print zone increases even more to remove the dried ink and replenish the ink at the inkjet nozzles with fresh ink (block 528). The ink absorbing the moisture from the humidified air in most cases decreases in viscosity and the operation of the inkjets clears the drying ink from the nozzles so the failing inkjets are returned to their operational status without adversely impacting the other inkjets. The test pattern is then reprinted (block 532) and the directionality of the ink drops from the inkjets is again compared to the directionality of the ink drops at the factory setting (block 536). If the test pattern lines are within the predetermined range, then the amplitude of the transducer signals is returned to the nominal value and printing is resumed (block 512). If the directionality degradation of the ink drops for the inkjets remains the same or has increased, then the controller determines whether a missing inkjet compensation scheme can be implemented for the failing inkjets (block 540). If it can be, the missing inkjet compensation scheme for the failing inkjets is implemented (block 544). A missing inkjet compensation scheme cannot be implemented if too many of the inkjets that would be used to eject ink to compensate for ink missing from the failing inkjets are also failing or have become inoperative. In this situation, printhead maintenance is required and printing operations are ceased (block 548). Otherwise, if the directionality comparison indicates the degraded directionality of the failing inkjets has been reversed (block 532), then printing is resumed (block 524).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

a plurality of printheads, each printhead having a plurality of inkjets operatively connected to a supply of ink;

a media transport for moving media past the printheads in a process direction;

an optical sensor positioned so the media passes the optical sensor after the media passes the plurality of printheads, the optical sensor being configured to generate image data of the media after the media has passed the plurality of printheads;

a diffuser positioned so the media passes the diffuser before the media passes the plurality of printheads, the diffuser being configured to emit humidified air toward the media passing the diffuser; and a controller operatively connected to the plurality of printheads, the media transport, the optical sensor, and the diffuser, the controller being configured to:

operate the media transport to move media past the diffuser, the plurality of printheads, and the optical sensor in the process direction;

operate the inkjets in the printheads to eject ink drops toward the media as the media passes the printheads to form a test pattern on the media;

receive from the optical sensor image data of the media after the test pattern has been formed on the media;

compare the image data of the media to stored image data of the test pattern printed at a previous time, identify a difference between the image data of the media and the stored image data of the test pattern, and determine whether the identified difference is greater than a predetermined threshold; and operate the diffuser to direct humidified air toward the media passing the diffuser when the difference between the image data of the media and the stored image data of the test pattern is greater than the predetermined threshold.

2. The inkjet printer of claim 1, the controller being further configured to:

identify a difference between the image data of the media and the stored image data of the test pattern for each inkjet that formed a portion of the test pattern on the media; and operating the diffuser using the identified differences for the inkjets that formed the test pattern on the media.

3. The inkjet printer of claim 2, the diffuser further comprising:

an array of transducers and a supply of water adjacent the array of transducers; and the controller is further configured to:

operate the transducers in the array of transducers at a predetermined level to direct uniformly humidified air toward the media passing the diffuser.

4. The inkjet printer of claim 3, the controller being further configured to operate the transducers independently using the identified differences for the inkjets that formed the test pattern on the media.

5. The inkjet printer of claim 4, the controller being further configured to:

independently operate the transducers by varying an amplitude of a signal provided to one or more of the transducers to alter an amount of moisture in the humidified air produced by the one or more transducers.

6. The inkjet printer of claim 4, the controller being further configured to:

independently operate the transducers by providing an energizing signal to less than all of the transducers to produce humidified air from some areas of the diffuser and not from other areas of the diffuser.

7. The inkjet printer of claim 6, the controller being further configured to:

independently operate the transducers by varying an amplitude of a signal provided to one or more of the transducers to alter an amount of moisture in the humidified air produced by the one or more transducers.

8. A method of operating an inkjet printer comprising:

operating with a controller a media transport to move media past a plurality of printheads in a process direction;

operating with the controller the plurality of printheads to form a test pattern on the media with one or more inkjets in the printheads;

generating with an optical sensor image data of the test pattern formed on the media after the media has passed the plurality of printheads;

comparing with the controller the image data of the media received from the optical sensor to stored image data of the test pattern printed at a previous time;

identifying with the controller a difference between the image data of the media and the stored image data of the test pattern;

determining whether the identified difference is greater than a predetermined threshold; and operating with the controller a diffuser to direct humidified air toward the media passing the diffuser before the media passes the plurality of printheads when the difference between the image data of the media and the stored image data of the test pattern is greater than the predetermined threshold.

9. The method of claim 8, the identification of the difference further comprising:

identifying a difference between the image data of the media and the stored image data of the test pattern for each inkjet that formed a portion of the test pattern on the media; and operating the diffuser with the controller using the identified differences for the inkjets that formed the test pattern on the media.

10. The method of claim 9 further comprising:

operating with the controller transducers in an array of transducers in the diffuser at a predetermined level to direct uniformly humidified air toward the media passing the diffuser.

11. The method of claim 10 further comprising:

operating the transducers in the array of transducers independently of one another using the identified differences for the inkjets that formed the test pattern on the media.

12. The method of claim 11, the independent operation of the transducers further comprising:

varying with the controller an amplitude of an energizing signal provided to one or more of the transducers to alter an amount of moisture in the humidified air produced by the one or more transducers.

13. The method of claim 11 further comprising:

providing an energizing signal to less than all of the transducers to produce humidified air from some areas of the diffuser and not from other areas of the diffuser.

14. The method of claim 13 further comprising:

varying an amplitude of the energizing signal to one or more of the transducers to alter an amount of moisture in the humidified air produced by the one or more transducers.

15. A directionality degradation detector configured for use in an inkjet printer comprising:

an optical sensor positioned so media passes the optical sensor after a test pattern has been formed on the media by at least a portion of the inkjets in a plurality of printheads, the optical sensor being configured to generate image data of the test pattern on the media;

a diffuser configured to emit humidified air toward the media before the test pattern is formed on the media; and a controller operatively connected to the optical sensor and the diffuser, the controller being configured to:

receive from the optical sensor image data of the media after the test pattern has been formed on the media;

compare the image data of the media to stored image data of the test pattern printed at a previous time, identify a difference between the image data of the media and the stored image data of the test pattern, and determine whether the identified difference is greater than a predetermined threshold; and operate the diffuser to direct humidified air toward the media passing the diffuser when the difference between the image data of the media and the stored image data of the test pattern is greater than the predetermined threshold.

16. The directionality degradation detector of claim 15, the controller being further configured to:

identify a difference between the image data of the media and the stored image data of the test pattern for each inkjet that formed a portion of the test pattern on the media; and operate the diffuser using the identified differences for the inkjets that formed the test pattern on the media.

17. The directionality degradation detector of claim 16, the diffuser further comprising:

an array of transducers and a supply of water adjacent the array of transducers; and the controller is further configured to:

operate the transducers in the array of transducers at a predetermined level to direct uniformly humidified air toward the media passing the diffuser.

18. The directionality degradation detector of claim 17, the controller being further configured to operate the transducers independently using the identified differences for the inkjets that formed the test pattern on the media.

19. The directionality degradation detector of claim 18, the controller being further configured to:

independently operate the transducers by varying an amplitude of a signal provided to one or more of the transducers to alter an amount of moisture in the humidified air produced by the one or more transducers.

20. The directionality degradation detector of claim 18, the controller being further configured to:

independently operate the transducers by providing an energizing signal to less than all of the transducers to produce humidified air from some areas of the diffuser and not from other areas of the diffuser.

21. The directionality degradation detector of claim 20, the controller being further configured to:

independently operate the transducers by varying an amplitude of a signal provided to one or more of the transducers to alter an amount of moisture in the humidified air produced by the one or more transducers.

* * * * *